US005864733A

United States Patent [19]

Mae et al.

[11] Patent Number: 5,864,733

[45] Date of Patent: Jan. 26, 1999

[54] DEVELOPING DEVICE FOR IMAGE FORMING APPARATUS

[75] Inventors: Asami Mae; Manabu Mochizuki, both of Yokohama; Kentaro Matsumoto, Ichikawa; Kenji Karashima, Kawasaki; Kazuhiko Yuki, Yokohama; Chikara Imai, Tokyo; Hajime Oyama, Ichikawa; Noriyuki Usui, Kawasaki, all of Japan

[73] Assignee: Ricoh Company, Ltd., Tokyo, Japan

[21] Appl. No.: 736,679

[22] Filed: Oct. 25, 1996

[30] Foreign Application Priority Data

Oct. 25, 1995 [JP] Japan ..... 7-277336
Apr. 2, 1996 [JP] Japan ..... 8-079939

[51] Int. Cl.[6] ..... G03G 15/00

[52] U.S. Cl. ..... 399/46; 399/55

[58] Field of Search ..... 399/46, 53, 55, 399/56, 168, 170, 171, 267, 270, 274, 285, 310, 311

[56] References Cited

U.S. PATENT DOCUMENTS 4,376,813 3/1983 Yuge et al. ..... 399/270 X
4,657,374 4/1987 Kuramoto et al. ..... 399/270
4,794,062 12/1988 Oka et al. ..... 399/170 X
4,814,834 3/1989 Endo et al. ..... 399/55
5,583,619 12/1996 Tanaka et al. ..... 399/171 X

FOREIGN PATENT DOCUMENTS 61-126578 6/1986 Japan .
61-112350 7/1986 Japan .
61-151553 7/1986 Japan .

*Primary Examiner*—Sandra Brase
*Attorney, Agent, or Firm*—Oblon, Spivak, McCelland, Maier & Neustadt, P.C.

[57] ABSTRACT

An image forming apparatus including a photoconductive drum, a charger which charges the photoconductive drum, an exposing device which irradiates light to the charged photoconductive drum for forming an electrostatic latent image on the photoconductive drum, a developing device which has two component developer which includes magnetic toner and magnetic carriers and a transfer charger to transfer the developed image to a sheet of paper. The bias voltages of the charger, the developing device and the transfer charger are applied from a common high voltage power source. A developing starting voltage of the developing device is higher than a residual voltage of the photoconductive drum.

10 Claims, 4 Drawing Sheets

DEVELOPING DEVICE FOR IMAGE FORMING APPARATUS

BACKGROUND OF THE INVENTION

FIELD OF THE INVENTION

The present invention relates to a developing device for an image forming apparatus such as copier, a printer, a facsimile machine or similar electrophotographic image forming apparatus. More particularly, the invention is concerned with a small image forming apparatus which has a single power source for applying a bias voltage to a charging device, a developing device and a transferring device.

DISCUSSION OF THE BACKGROUND

An image forming apparatus has a charging device, a developing device and a transferring device in which a high voltage is applied from a power source to the charging device, the developing device and the transferring device. A conventional image forming apparatus has a plurality of power sources that include the power source for the charging device, the power source for the developing device and the power source for the transferring device. As a result, the cost of the apparatus becomes high and the size of the apparatus becomes large. Therefore, it is essential for a compact and a low price image forming apparatus to reduce the number of power sources.

Japanese Laid-open Publications No. 61-151553, No. 61-112350 and No. 61-126578 disclose an image forming apparatus in which a high voltage is applied from a single power source to a charging device and a transferring device. However, these image forming apparatuses need a power source for a developing device. Therefore, the cost of the apparatuses becomes high and the size of the apparatuses becomes large.

If the high bias voltage is applied from a single power source to the charging device, the developing device and the transferring device, the cost of the apparatus becomes low and the size of the apparatus becomes small. However, if the apparatus uses a regular developing device, and a toner image is transferred from the developing device to a charged area of a photoconductive element, the following drawbacks occur.

If the power source for the charging device, developing device and the transferring device is a common power source, the bias voltage is applied to each device at the same time and application of the bias voltage to each device is stopped at the same time. Therefore, when the power source is turned off, the bias voltage to the charging device and the developing device is stopped at the same time. As a result, the electric potential that is applied from the charging device to the photoconductive element remains on the surface of the photoconductive element between the charging device and the developing device with respect to the rotating direction of the photoconductive element. If a successive image forming operation starts in that condition, the toner image is transferred to the surface of the photoconductive element between the charging device and the developing device with respect to the rotating direction of the photoconductive element.

The electric potential on the surface of the photoconductive element is erased by irradiating a light. Therefore, the aforementioned drawbacks will be solved by irradiating the light from an erase lamp during a post-rotation period of time of the photoconductive element. However, a residual voltage on the photoconductive element increases as the number of prints increases, even if the light is irradiated from the erase lamp. Therefore, even if the developing bias voltage is turned off, toner in the developing device is transferred to the photoconductive element by the electric potential between the developing bias voltage, OV, and the residual voltage on the photoconductive element.

Before executing the image forming operation, the photoconductive element rotates, and then the power source is turned on. If the image forming operation starts immediately after the preceding image forming operation was completed, toner in the developing device is transferred to the photoconductive element since the residual voltage on the surface of the photoconductive element has remained. The toner transferred to the photoconductive element is scattered by an air current that occurs with rotation of the photoconductive element, and then the scattered toner adheres on a pre-transfer guide plate. If the pre-transfer guide plate is made of an insulating material, not only is the toner scattered but the toner on the photoconductive element is also adhered to the pre-transfer plate under the influence of an electrical charge that is charged on the plate by discharge of electricity of the transfer charger. If a sheet of paper passes through the plate in that condition, toner on the pre-transfer plate drops on the sheet of paper. As a result the quality of the image becomes poor.

If a developing roller has an electrical charge having a polarity which is opposite to the polarity of the toner, toner on the developing roller is not transferred to the photoconductive element even though the residual voltage on the photoconductive element has remained. The electrical charge on the developing roller has remained after the power source was turned off when the developing roller is in a floating condition. In order to make the developing roller maintain an electric charge during the floating condition after the power source is turned off, a switching part is required. However, the switching part for the high voltage power source is very expensive. Depending on the circumstances, the switching parts may be more expensive than the power source itself. Therefore, it is impossible to use a power source with the switching part for a compact and inexpensive image forming apparatus.

SUMMARY OF THE INVENTION

Accordingly, it is an object of this invention to provide an image forming apparatus that solves the aforementioned drawbacks.

It is another object of this invention to provide a compact and an inexpensive image forming apparatus.

It is yet another object of this invention to provide an image forming apparatus which can form an image of good quality.

In order to achieve the above-mentioned and other objects, according to the present invention, an image forming apparatus for forming a toner image on a sheet of paper includes an image bearing device, a charging device for charging the image bearing device, an exposing device for forming an electrostatic latent image on the image bearing device, a developing device for developing the electrostatic latent image on the image bearing device, a transferring charger for transferring the developed image, and a high voltage power source for applying a bias voltage to the charging device, the developing device and the transferring charger.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
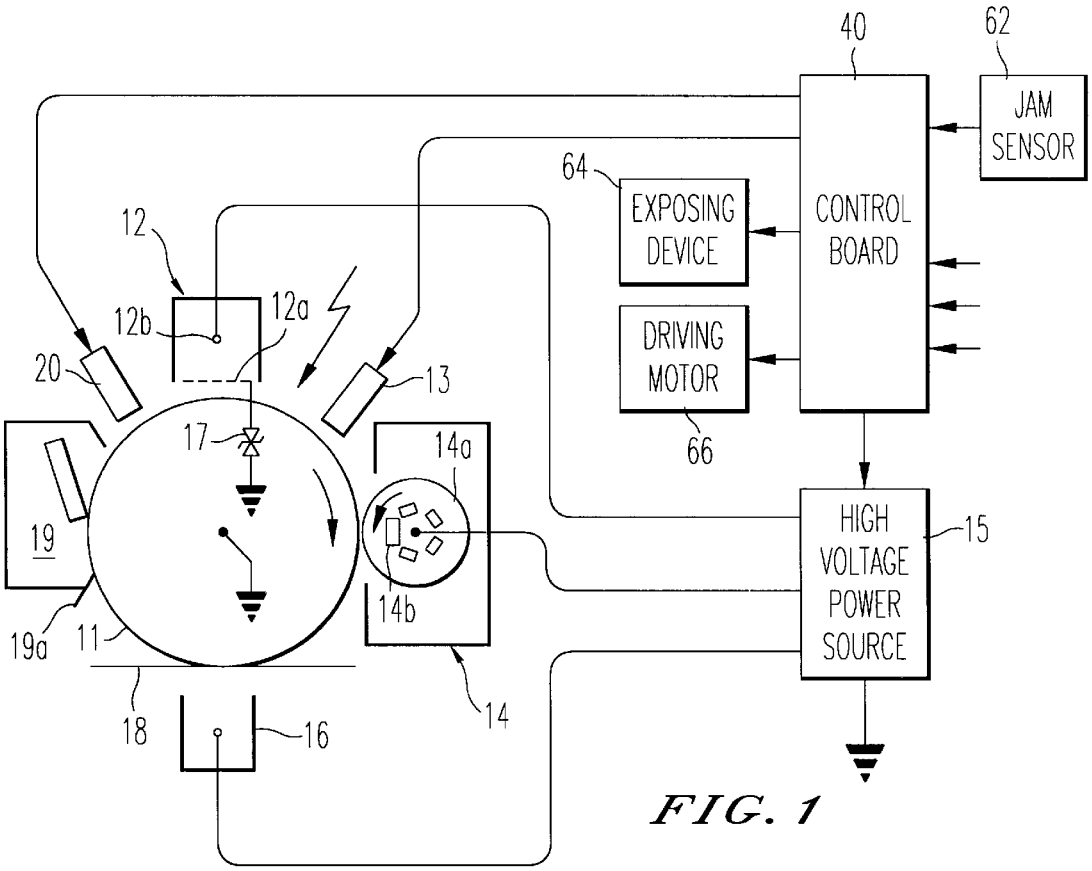
FIG. 1 is a partly sectional fragmentary schematic view of an image forming apparatus of the present invention.

Referring now to the drawings, wherein like reference numerals designate identical or corresponding parts throughout the several views, and more particularly to FIG. 1 thereof, a copier embodying the present invention is shown and includes a photoconductive drum 11 which is driven by a drive motor to rotate in the direction indicated by an arrow. The photoconductive drum 11 is charged by a scorotron charger 12 which includes a grid, and then it is exposed by an exposing device to form an electrostatic latent image. An unused electrical charge of a non-image area on the photoconductive drum 11 is discharged by an eraser 13. The electrostatic latent image is then developed by a developing device 14 which includes a two component developer. The two component developer includes magnetic toner and a magnetic carrier. The developing device 14 includes a developing sleeve 14*a* which transports the developer to a developing area to develop the electrostatic latent image.

A developing bias voltage is applied to the developing sleeve 14*a* from a high voltage power source 15 which is a constant voltage power source. The high voltage power source 15 also applies the high voltage to the scorotron charger 12 and a transfer charger 16. A grid 12*a* of the scorotron charger 12 is grounded via a constant voltage part or circuit 17 which can be implemented using two zener diodes or a diode regulator. Charging electrode 12*b* discharges current which flows to an earth via the grid 12*a* and the constant voltage part 17, and therefore a constant voltage is applied to the grid 12*a*.

A sheet of paper 18 is fed from a paper feed device to a transferring position. At the transferring position, the toner image on the photoconductive drum 11 is transferred to the sheet of paper 18 by the transfer charger 16. The toner image on the sheet of paper 18 is then fixed by a fixing device (not shown). A charge control guide which controls a charging area to prevent occurrence of dust of an image and a pre-transfer guide plate are provided. After the transferring operation, residual toner on the photoconductive drum 11 is cleaned by a cleaning device 19 having a cleaning blade 19*a*. A residual electrical charge is discharged by an erasing lamp 20.

Figure 2:
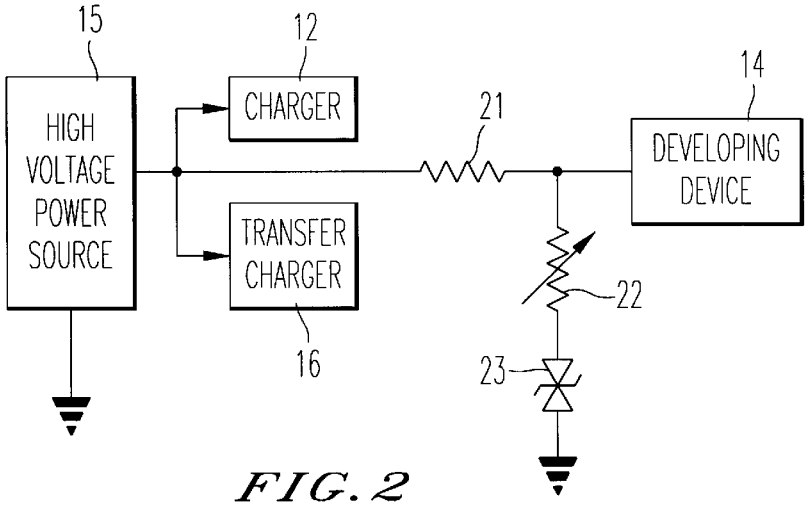
FIG. 2 shows a power source of FIG. 1.

As shown in FIG. 2, the high voltage power source 15 is connected to the charging electrode of the scorotron charger 12 and that of the transfer charger 16. Further the high voltage power source 15 is connected to the developing sleeve 14*a* via a resistor 21, a variable resistor 22 and a constant voltage part or circuit 23 which can be implemented using two zener diodes or a diode regulator. The voltage of the high voltage power source 15 is controlled by the resistor 21, the variable resistor 22 and the constant voltage part 23, and then the controlled voltage is applied to the developing sleeve as a developing bias voltage. The developing bias voltage is variably controlled by the variable resistor 22. In this embodiment, the high voltage power source 15 is a constant voltage power source. The constant voltage power source can apply a stable high voltage to the scorotron charger 12, the developing device 14 and the transfer charger 16, since the output voltage of the power source is not influenced by the change of the electrical condition of each of the devices 12, 14 and 16. If the high voltage power source is a constant current power source, the current which flows in each of the devices 12, 14 and 16 is changed by the change of the electrical condition of each of the devices 12, 14 and 16.

In this embodiment, the scorotron charger 12 is used as a charging device. Since the charging voltage on the photoconductive drum 11 is determined by a condition of the grid 12*a*, for example a distance between the grid 12*a* and the surface of the photoconductive drum 11, and a voltage of the grid 12*a*, it is not necessary for the power source 15 to control the output voltage exactly if the current that flows into the charging electrode is higher than a predetermined value. Therefore, the scorotron charger 12 is favorable when the power source 15 is common to the charging device 12, the developing device 14 and the transfer charger 16.

A paper jam detecting sensor 62 and various other sensors (not illustrated) which sense conditions of the copier transmit detecting signals to a control board 40. The control board 40 controls a driving motor 66, eraser 13, the exposing device 64, the high voltage power source 15, the discharging lamp 20 and so on as shown in FIG. 1.

Figure 3:
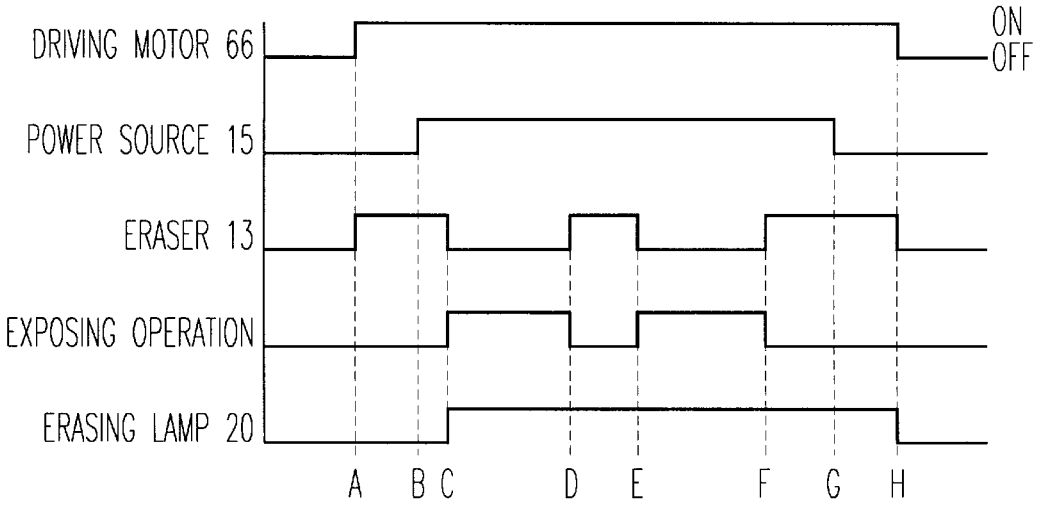
FIG. 3 shows the timing of an operation of the image forming units of FIG. 1.

In FIG. 3, when a copy start signal is inputted to the control board 40, the control board 40 outputs a control signal to turn on the driving motor 66 which rotates the photoconductive drum 11 (pre-rotation), the eraser 13 and the discharging lamp 20 at time A. After a predetermined period of time passes, the high power source 15 is turned on at time B. Therefore, the scorotron charger 12, the developing device 14 and the transfer charger 16 are also turned on at time B. When the surface of the photoconductive drum 11 which faces to the scorotron charger 12 reaches the developing device 14, the eraser 13 is turned off, and therefore the electrical charge on an area which corresponds to the area between the scorotron charger 12 and the developing device 14 is discharged. As a result, toner in the developing device does not adhere to the photoconductive drum 11 before the formation of the electrostatic latent image. When the eraser 13 is turned off at time C, the exposing lamp is turned on. After the exposing operation is finished, the exposing lamp is turned off at time D. At the same time, the eraser 13 is turned on. Then successive exposing operations start at time E, and the exposing operation is finished at time F. After a selected number of copies have been made finished, the high power source 15 is turned off at time G, and at the same time the scorotron charger 12, the developing device 14 and the transfer charger 16 are also turned off. After the high voltage power source 15 is turned off, the photoconductive drum 11 continues its rotation (post-rotation), and therefore the electrical charge on the photoconductive drum 11 is discharged from time G to time H, and then the drive motor, the eraser 13 and the discharging lamp 20 are turned off at time H. According to the present embodiment, since the electrical charge of the non-image area of the photoconductive drum 11 is discharged by the eraser 13 and the discharging lamp 20, the toner does not adhere to the non-image area of the photoconductive drum 11.

Figure 4A:
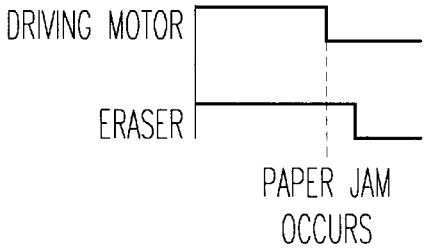
FIG. 4 shows the timing of an operation of a driving motor for a photoconductive drum when a paper jam occurs.
Figure 4B:
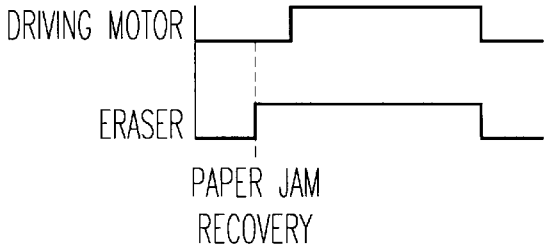

When a paper jam occurs, the driving motor which rotates the photoconductive drum 11 is turned off, and subsequently the eraser 13 is turned off as shown in FIG. 4(*a*). When the image forming operation starts after recovery from the paper jam, the eraser 13 is turned on, and subsequently the driving motor is turned on as shown in FIG. 4(*b*). If the driving motor and the eraser 13 are turned off at the same time, the electrical charge remains on an area between the scorotron charger 12 and the eraser 13 on the photoconductive drum 11. The toner adheres to the area when the image forming operation starts after recovery from the paper jam. According to the present embodiment, even if the paper jam occurs, the electrical charge on the photoconductive drum 11 is discharged and the toner does not adhere to the non-image area on the photoconductive drum.

Figure 5:
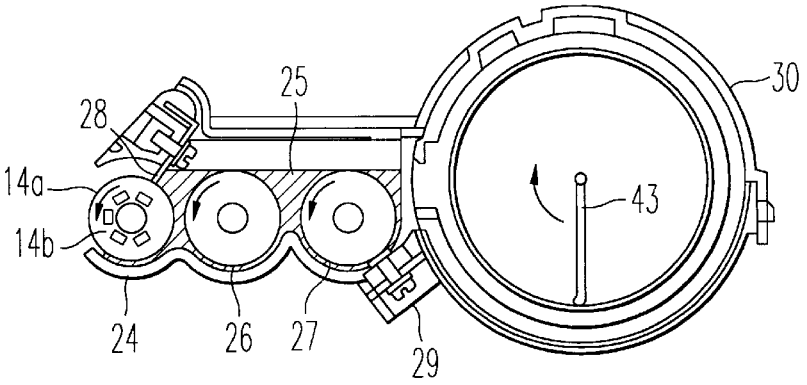
FIG. 5 is a partly sectional fragmentary schematic view of a developing device of the present invention.
Figure 6:
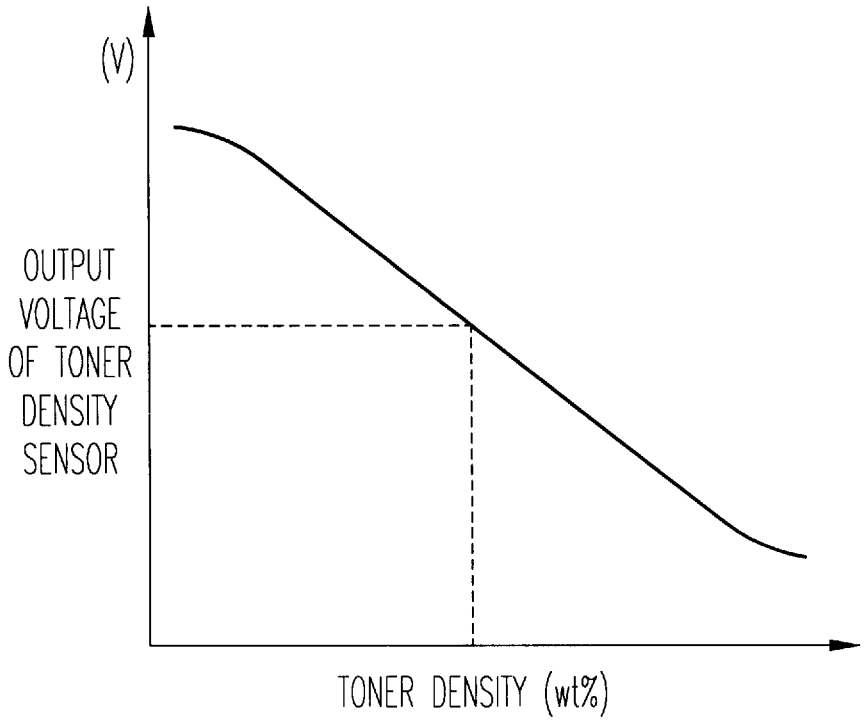
FIG. 6 is a graph showing a relationship between a toner density and an output of a toner density sensor.
Figure 7:
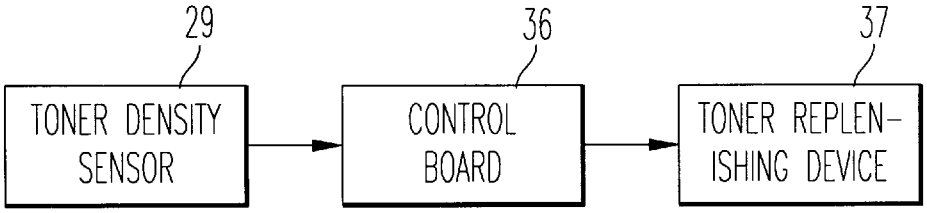
FIG. 7 is a block diagram of toner density controller.

FIG. 5 shows the developing device 14 of the this embodiment. In FIG. 5, the two component developer 25 which includes the magnetic toner and the magnetic carrier is agitated by agitators 26 and 27. At the same time, the two component developer 25 is transported from a toner hopper 30 to the developing sleeve 14*a* by the agitators 26 and 27. The developing sleeve 14 and the agitators 26 and 27 are driven by the drive motor. The agitators 26 and 27 transport the two component developer 25 along the longitudinal direction of each of agitators 26 and 27. During the agitating operation, the developer 25 is also transported from the agitator 26 to the agitator 27 at both ends of the agitators 26 and 27 with respect to the longitudinal direction of the agitators 26 and 27, and then the developer 25 is transported to the developing sleeve 14*a* from the agitator 26. The developing sleeve 14*a* includes magnets 14*b* which form a magnetic brush of the two component developer 25 on the developing sleeve 14*a*. The magnetic brush is transported to a developing area where the developing sleeve 14*a* faces to the photoconductive drum 11 by rotation of the developing sleeve 14*a*. The height of the magnetic brush is controlled by a doctor blade 28 before the developing brush reaches the developing area. Toner density of the two component developer 25 in the developing device 14 is detected by a toner density sensor 29. As shown in FIG. 6, the output voltage of the toner density sensor 29 is proportional to the toner density in the developing device 24. In FIG. 7, if a control board 36 detects that the output voltage of the toner density sensor 29 reaches a predetermined value, the control board 36 transmits a control signal to a toner replenishing device 37 which is provided in the toner hopper 30 to replenish the developing device 24 with toner from the hopper 30. In practice, the control board 36 may be different from, or the same as, the control board 40 illustrated in FIG. 1.

Figure 8:
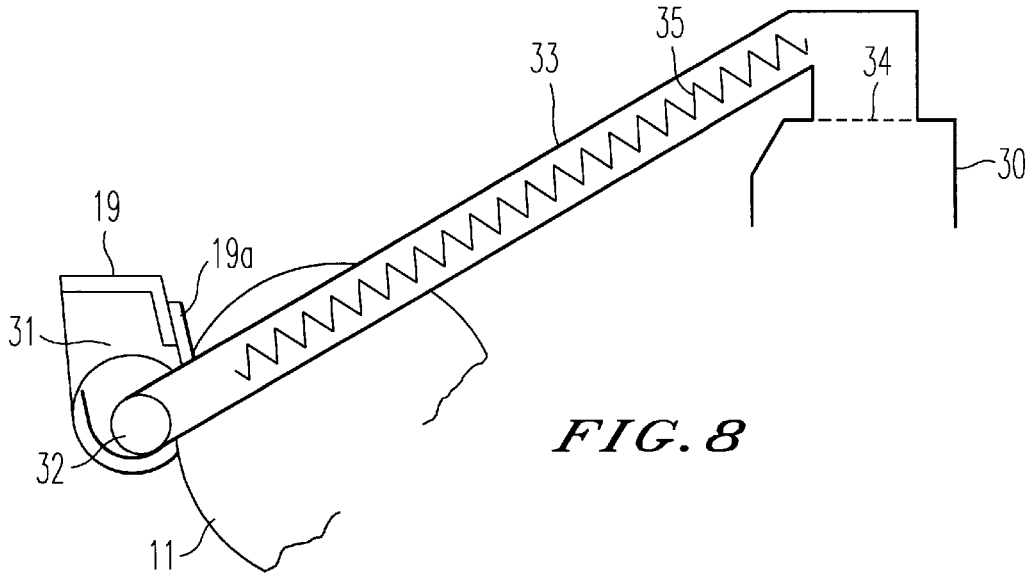
FIG. 8 shows a toner recycle mechanism of the present invention.

Referring to FIG. 8, the cleaning device 19 includes a cleaning blade 19*a*, a toner tank 31 and a toner transport device 32 which is driven by the drive motor. The residual toner on the photoconductive drum 11 is cleaned by the cleaning blade 19*a* and then the toner is transported to the hopper 30 via the transporting device 32, transporting screw 33 which is provided in a pipe 35 and is driven by the driving motor and a toner replenishing opening 34. In the hopper 30, the toner which is transported from the cleaning device 19 is mixed with new toner by an agitator 43 illustrated in FIG. 5. The number of rotations of the transporting screw 33 is higher than that of the transporting device 32. The transporting device 32 and the transporting screw 33 are driven during the rotation of the photoconductive drum 11.

The hopper 30 includes two replenishing openings; one is for new toner and the other is for recycled toner which is transported from the cleaning device 19. Further, the hopper includes a toner-end sensor which detects a toner-end in the hopper 30. If the toner-end sensor detects the toner-end, the control board 36 transmits a toner-end signal to an operation panel of the copier. The new toner is replenished from the new toner replenishing opening by an operator. After the replenishing operation, the toner in the hopper 30 is mixed by the agitator 43.

In this embodiment, since the two component developer which includes the magnetic toner and the magnetic carrier is used, a developing starting voltage is higher than the residual voltage of the photoconductive drum 11. Therefore, even if the residual voltage of the photoconductive drum 11 increases, toner does not adhere to the non-image area of the photoconductive drum 11.

The inventors performed an experiment using the following developing conditions.

A gap Gp between the photoconductive drum 11 and the developing sleeve 14*a* was 0.55 mm. A gap Gd between the developing sleeve 14*a* and the doctor blade 28 was 0.5 mm. A ratio of the surface velocity of the photoconductive drum 11 to that of the developing sleeve 14*a* was one to three. The strength of a main magnet 45 was 85 mT. The developing bias voltage was OV, namely, the high voltage power source was turned off.

Figure 9:
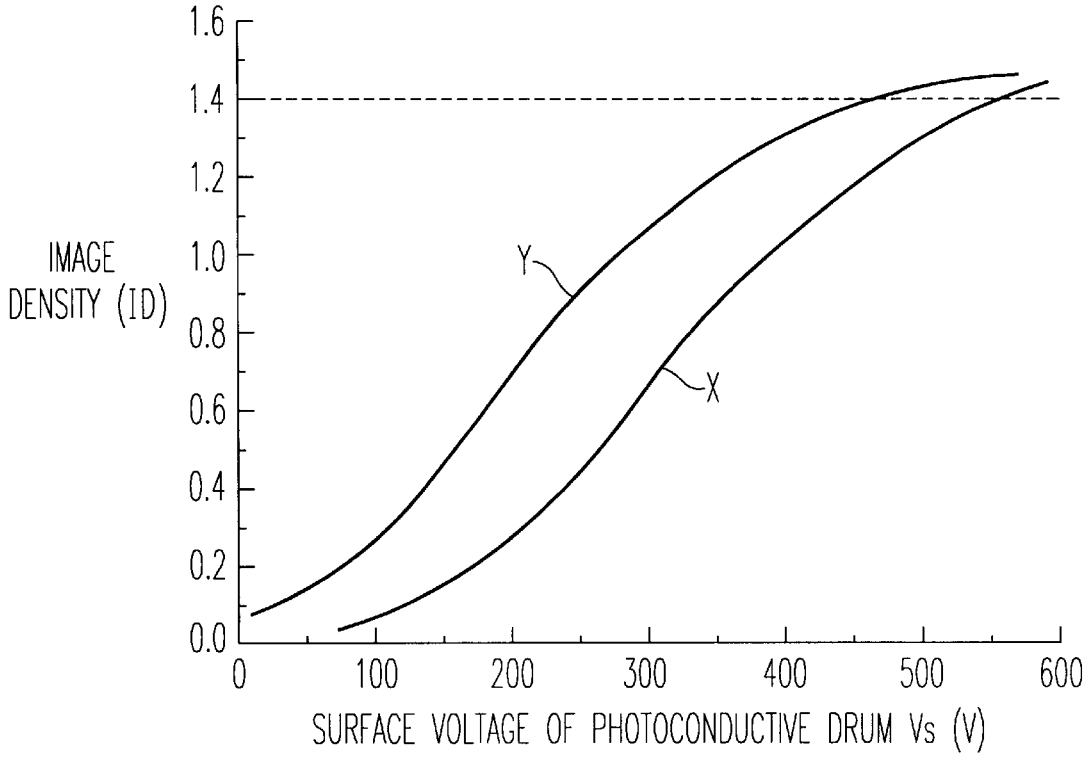
FIG. 9 is a graph showing a relationship between a surface voltage of a photoconductive element and an image density.

The result of the experiment is shown in FIG. 9. In FIG. 9, a curved line X shows a relationship between the surface voltage Vs of the photoconductive drum 11 and the image density (ID) on the sheet of paper ID when the two component developer and the developing condition were in accordance with the aforementioned conditions. A curved line Y shows the relationship when a two component developer includes non-magnetic toner and a magnetic carrier. As a result of the experiment, it was determined that even if the residual voltage of the photoconductive drum that is usually less than 80 V remains, a toner image was not formed on the sheet of paper in the aforementioned condition.

The toner which can be used in the present embodiment is made by a known process as follows: Firstly, melting and mixing mixture of fixing resin, a magnetic material, a polarity control material and additives, if necessary, secondly, hardening by cooling the mixture, thirdly, crushing the mixture, and finally, mixing additives with the mixture, if necessary.

The following known materials can be used alone or mixed as the fixing resin. The materials are for example, styrene such as polystyrene, poly-p-styrene and polyvinyltoluene, uni-polymer or homo-polymer of a substitution product of itself, styrene group copolymer such as styrene-p-chlorstyrene copolymer, styrene-propylene copolymer, styrene-vinyltoluene copolymer, styrene-acrylic acid methyl copolymer, styrene-acrylic acid ethyl copolymer, styrene-acrylic acid butyl copolymer, styrene-methacrylic acid methyl copolymer, styrene-methacrylic acid ethyl copolymer, styrene-methacrylic acid butyl copolymer, styrene-α-chloromethacrylic acid methyl copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer and styrene-maleic acid ester copolymer, poly methyl methacrylate, poly butyl methacrylate, polyvinyl chloride, poly vinyl acetate, polyethylene, polypropylene, polyester, polyurethane, polyamide, epoxy resin, polyvinyl butyral, polyacryl acid resin, rosin, denaturation rosin, terpinen resin, phenol resin, aliphatic compound, aliphatic hydrocarbon resin, aromatic petroleum resin, chlorine paraffin and paraffine wax. Especially, polyester resin is suitable for the fixing resin since offset preventability to a heat roller of a fixing device is good.

The following known materials can be used as polarity control materials. The material are, for example, metal complex salt of mono azo dye, nitro humin acid, nitro humin acid salt, salicylic acid, naphthionic acid, metal complex amino compound, the fourth grade ammonium compound and organic pigment.

The quantity of the polarity control material is changed depending on a kind of the fixing resin, presence of the additives, and toner manufacturing process. However, the charge control material is usually used under the following quantity that is from 0.1 to 20 parts by weight to 100 parts by weight of the fixing resin. If the quantity of the polarity control material is less than 0.1, the toner is short of the electrical charge. If the quantity of the polarity control material is more than 20 parts by weight, the toner is too charged, and therefore the toner adheres to the carrier strongly. As a result, the image on the sheet of paper becomes thin.

The following materials can be used as the magnetic material of the magnetic toner. The magnetic material are, for example, iron oxide such as magnetite, hematite, ferrite and so on, metal such as iron, cobalt and nickel and alloy or mixture of the metal and aluminum, cobalt, copper, lead, magnesium, tin, zinc, antimony, beryllium, bismuth, cadmium, calcium, manganese, selenium, titanium, tungsten and vanadium. It is desirable that a size of these ferromagnetic materials be from 0.1 $\mu$m to 2 $\mu$m. Further, it is desirable that the ferromagnetic material content to resin of the toner is from 20 parts by weight to 300 parts by weight to 100 parts by weight, and more desirably it is from 30 parts by weight to 200 parts by weight to 100 parts by weight.

It is also possible to add coloring to the toner if it is necessary Carbon black, aniline black, furnace black, lamp black and so on can be used as black coloring. Phthalocyanine blue, methylene blue, victoria blue, methyl violet blue, aniline blue, ultramarine blue and so on can be used as cyan coloring. Rhodamine 6G lake, dimethyl quinacridone, watchung red, rose bengal, rhodamine B, alizarin lake and so an can be used as magenta coloring. Chromium yellow, benzidine yellow, hansa yellow, naphthol yellow, molybdenum orange, quinpline yellow, tartrazine and so on can be used as yellow coloring.

It is also possible to add the additive to the toner, such as a sliding material, abrasives, a fluidity adding material, a conductivity adding material, a caking preventing material, a fusing assistant material and so on. Teflon and stearic acid zinc can be used as the sliding material. Cerium oxide, zirconium oxide, silicon oxide, titanium oxide, aluminum oxide, silicon carbide and so on can be used as the abrasives. The aluminum oxide or the silicon carbide is the most suitable for the abrasives. Colloid silica, aluminum oxide and so on can be used as the fluidity adding material. The colloid silicon is the most suitable for the fluidity adding material. Carbon black, tin oxide and so on can be used as the conductivity adding material. Low molecular weight polyolefin can be used as the fusing assistant material.

The toner of which size is 0.8 $\mu$m on the average is made by firstly, melting and mixing the following mixture at 12° C. by a heating roll, secondly, harding by cooling it, thirdly, crushing it by a jet mill and finally, dividing it. The saturation magnetization of the toner is 21 $A \cdot m^2/kg$ in the magnetic field of 8.0×104 A/m. The mixture includes styrene-acrylic resin (HAIMA 75 made by Sanyokasei) of 100 parts by weight, carbon black (#44 made by Mitsubishikasei) of 5 parts by weight, nigrosine(NIGROSINEBASE EX mage by Orientokagaku) of 2 parts by weight, magnetite particles (EPT-1000 made by Todakogyosha) of 100 parts by weight.

The carrier is made by the following process. Slurry of magnetite is compensated by mixing magnetite which is made by a wet process of 100 parts by weight, polyvinyl alcohol of 2 parts by weight and water of 60 parts by weight for 12 hours in a ball mill. Secondly, the slurry is sprayed by a spray drier, and then spherical particles of 8 $\mu$m on the average are made. The spherical particles are burned for 3 hours at 1000° C. in a nitrogen atmosphere and then core particles are obtained by cooling the burned particles. Covered layer forming liquid is compensated by dispersing mixture which includes silicon resin solution (SR-24 10 made by Tore-Daukoningushilicon) of 100 parts by weight, toluene of 100 parts by weight, methyltrimethoxysilane of 6 parts by weight and carbon black (#44 made by Mitsubishikasei) of 10 parts by weight for 20 minutes. Carrier covered by silicon resin is obtained by coating the core particles of 1000 parts by weight with the covered layer forming liquid by a coating apparatus. The size of the carrier covered by silicon resin is 63 $\mu$m on the average and the saturation magnetization of the toner is 66 $A \cdot m^2/kg$.

According to the present embodiment, since the aforementioned magnetic toner and the magnetic carrier are used as the two component developer and the toner is adhered to the carrier by magnetic force, the voltage of starting the developing operation is higher than the residual voltage VR of the photoconductive drum 11. As a result, toner does not adhere to the non-image forming area of the photoconductive drum 11 even if the developing bias voltage from the high voltage power source 15 which is common to the scorotron charger 12, the developing device 14 and the transfer charger 16 is OV.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus for forming a toner image on a sheet of paper, comprising:

image bearing means;

charging means for charging said image bearing means;

means for forming an electrostatic latent image on said image bearing means;

developing means for developing said electrostatic latent image on said image bearing means;

transferring means for transferring said developed image; and means for applying a bias voltage to said charging means, said developing means and said transferring means, wherein said developing means includes a two component developer comprising magnetic toner and magnetic carriers, and wherein said developing means comprises means for bearing said two component developer, means for regulating the thickness of said two component developer on said bearing means and means for adhering said two component developer on said bearing means, wherein said developing starting voltage is controlled in response to a gap between said image bearing means and said bearing means, a gap between said bearing means and said regulating means, a ratio of the surface velocity of said bearing means to that of said image bearing means, and an adhering force of said adhering means.

2. An apparatus as claimed in claim 1, wherein a developing starting voltage of said developing means is higher than a residual voltage of said image bearing means.

3. An apparatus as claimed in claim 1, wherein said charging means comprising a scorotron charger which has a charging electrode and a grid.

4. An apparatus as claimed in claim 1, wherein said applying means comprises a constant voltage power source.

5. An image forming apparatus, comprising:

an image bearing device;

a charger which charges said image bearing device;

an exposing device which irradiates light to said charged image bearing device for forming an electrostatic latent image on said image bearing device;

a developing device which has developer for developing said image bearing device by said developer; and a transfer charger to transfer said developed image to a medium, wherein a developing starting voltage of said developing device is higher than a residual voltage of said image bearing device, wherein said developer includes a two component developer comprising magnetic toner and magnetic carriers, and wherein said developing device comprises a developing sleeve which faces said image bearing device and bears said two component developer, a doctor blade which controls the quantity of said developer on said developing sleeve and a plurality of magnets which are provided in said developing sleeve, wherein said developing starting voltage is controlled in response to a gap between said image bearing device and said developing sleeve, a gap between said developing sleeve and said doctor blade, a ratio of the surface velocity of said developing sleeve to that of said image bearing device, and a magnetic force of said magnets.

6. An apparatus as claimed in claim 5, further comprising:

a power source which is connected to said charger, said developing device and said transfer charger to apply a high voltage to said charger, said developing device and said transfer charger.

7. An image forming apparatus, comprising:

an image bearing means;

charging means for charging said image bearing means;

means for forming an electrostatic latent image on said image bearing means;

a developing means for developing said electrostatic latent image on said image bearing means, wherein a developing starting voltage of said developing means is higher than a residual voltage of said image bearing means; and means for transferring said developed image to a recording medium, wherein said developing means includes a two component developer comprising magnetic toner and magnetic carriers, and wherein said developing means comprises means for bearing said two component developer, means for regulating the thickness of said two component developer on said bearing means and means for adhering said two component developer on said bearing means, wherein said developing starting voltage is controlled in response to a gap between said image bearing means and said bearing means, a gap between said bearing means and said regulating means, a ratio of the surface velocity of said bearing means to that of said image bearing means, and an adhering force of said adhering means.

8. An apparatus as claimed in claim 7, further comprising means for applying a bias voltage to said charging means, said developing means and said transferring means.

9. An image forming apparatus for forming a toner image on a sheet of paper, comprising:

image bearing means;

charging means for charging said image bearing means;

means for forming an electrostatic latent image on said image bearing means;

developing means for developing said electrostatic latent image on said image bearing means;

transferring means for transferring said developed image; and means for applying a bias voltage to said charging means, said developing means and said transferring means, wherein said means for applying includes a resistor between a high voltage power source and said developing means, and a variable resistor connected in series with a constant voltage device, said variable resistor and said constant voltage device being connected to a ground and to a point between said resistor and said developing means.

10. An image forming apparatus, comprising:

an image bearing device;

a charger which charges said image bearing device;

an exposing device which irradiates light to said charged image bearing device for forming an electrostatic latent image on said image bearing device;

a developing device which has developer for developing said image bearing device by said developer; and a transfer charger to transfer said developed image to a medium, wherein a developing starting voltage of said developing device is higher than a residual voltage of said image bearing device.

* * * * *